United States Patent [19]

Baker

[11] Patent Number: 4,982,932

[45] Date of Patent: Jan. 8, 1991

[54] FENCE CLIP ASSEMBLY

[76] Inventor: Wayne Baker, P.O. Box 158, Freedom, Wyo. 83120

[21] Appl. No.: 232,457

[22] Filed: Aug. 15, 1988

[51] Int. Cl.[5] ..... E04H 17/02

[52] U.S. Cl. ..... 256/47; 256/10; 256/1; 256/52; 256/48; 174/154; 248/72

[58] Field of Search ..... 256/47, 48, DIG. 3, 256/10, 54, 58, 52, 32, 1; 174/154, 155; 24/563, 570; 248/72, 227, 229, 301, 297.3

[56] References Cited

U.S. PATENT DOCUMENTS

| | | | |
|---|---|---|---|
| 363,805 | 5/1887 | Cleaver | 256/48 |
| 803,706 | 11/1905 | McMaster | 256/48 X |
| 1,045,027 | 11/1912 | Hicks | 256/48 |
| 2,291,430 | 7/1942 | Ingersoll | 174/154 |
| 2,537,719 | 1/1951 | Tuepker | 248/72 |
| 4,077,611 | 3/1978 | Wilson | 256/47 X |

FOREIGN PATENT DOCUMENTS

| | | | |
|---|---|---|---|
| 1380669 | 10/1964 | France | 256/10 |
| 24918 | 11/1906 | United Kingdom | 256/48 |

*Primary Examiner*—Randolph A. Reese
*Assistant Examiner*—Franco S. DeLiguori
*Attorney, Agent, or Firm*—M. Reid Russell

[57] ABSTRACT

A fence clip assembly for securing strands of fencing wire and the like to wood and metal fence posts and including a pair of ears with holes therethrough and a main body with a wire holder that may comprise a pin to lock strands of wire to a clip by insertion through aligned holes in flanges and that is removable to allow the wire to be readily released and that further includes an insulator connector to insulate supported electrical wires at the fence poles.

1 Claim, 2 Drawing Sheets

FENCE CLIP ASSEMBLY

BRIEF DESCRIPTION OF THE INVENTION

1. Field of the Invention

This invention relates to fence connectors and is particularly concerned with connectors used to attach both electrified and non-electrified barbed and barb-less wire strands to support posts.

2. Prior Art

For many years barbed and barb-less wire strands have been attached to support posts to provide fences for livestock and the like and to mark property boundaries. When used with wooden support posts the wire strands are generally attached with U-shaped nails that straddle the strand and that are driven into the post. The nails eventually work out of the posts, particularly as the posts decay and they must then be replaced. Metal support posts have also been developed and are frequently used. The posts most frequently used are of a generally T-shaped cross-sectional configuration and with spaced alignment guides to maintain spacing of plural strands making up a fence. The wire strands are each secured to a metal post with a short wire length that has one end wrapped around a strand, that is then passed around a post and with the other end then wrapped again around the strand to hold the strand to the post.

To provide a tightly stretched fence, using the conventional U-shaped nails or wire post ties and barbed or barb-less wire it has been necessary to employ a wire puller to stretch each length of wire between adjacent posts. After the fence has been constructed the strands may have to be released and lowered to permit livestock to move across, or in some areas to prevent breakage of posts when snow loads act on the fence. The barbed and barb-less fences may also be electrified by directing a pulsating electric charge through the wire, and providing insulator connectors to carry the wire strands past the posts.

OBJECTS OF THE INVENTION

Principal objects of the present invention are to provide a fence assembly clip that can be used with either wooden or conventional metal fence posts and fence strands that can be insulated at the post to accommodate electrification of the fence strands and that will securely support strands of wire fencing that is either barbed or barb-less. Another object is to provide a fence clip that will permit the wire strands to be easily released and lowered, if desired.

Yet another object is to provide a fence clip assembly that includes insulators readily attached to the wire and to a clip to provide for easy installation and lay-down of an electrified fence.

FEATURES OF THE INVENTION

Principal features of the invention include a fence clip with a main body, having a wire holder that in one embodiment has bendable side flanges and a pair of spaced apart upper and lower ears projecting from the main body and a pin having a head thereon insertable through the ears to hold a wire strand between the main body, the spaced apart ears and the pin. The assembly of the invention also includes insulators that are held by the clip and that receive an electrified wire such that the wire is easily layed down.

In another embodiment the wire holder comprises a half-tube segment attached to a flat segment interconnecting the spaced apart ears.

In still another embodiment a half-tube segment has the spaced apart ears extending in opposite angular directions thereon.

Additional objects and features of the invention will become apparent to those skilled in the art to which the invention pertains from the following detailed description and claims.

THE DRAWING

In the drawing:

FIG. 1 is a perspective view of a first embodiment of the clip of the invention;

FIG. 2, a perspective view of a second embodiment of the clip of the invention;

FIG. 3, a similar view showing a clip of the invention mounted on a wooden fence post, shown fragmentarily, and supporting a strand of barbed wire;

FIG. 4, a view like that of FIG. 3, but showing the clip mounted on a conventional metal post and with an insulator connector supporting a strand of electrified barbed wire;

FIG. 5, a perspective view of an insulator of the invention;

FIG. 6, a perspective view of another embodiment of the clip of the invention;

FIG. 7, a similar view of still another embodiment;

FIG. 8, a perspective view of the clip of FIG. 6, shown mounted on a metal post, shown fragmentarily;

FIG. 9, a similar view showing the clip of FIG. 7 shown mounted on a wooden post;

FIG. 10, a perspective view of a clip and another embodiment of insulator connector, shown receiving a wire; and FIG. 11, a view like that of FIG. 10, but showing the wire in the insulator connector and the connector secured in a clip.

DETAILED DESCRIPTION

Figure 1:
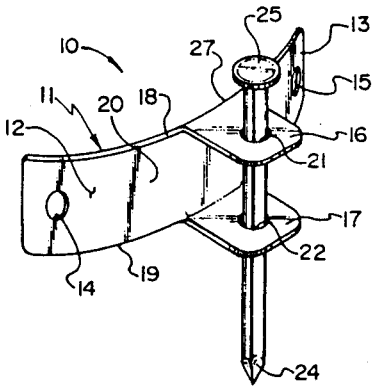

Referring now to the drawing:

In the illustrated preferred embodiment of FIG. 1, the clip of the assembly is shown generally at 10 and includes a main body 11 made of a strong, durable material, such as galvanized steel. The main body 11 has flanges, 12 and 13 respectively, extending from opposite sides thereon. Holes 14 and 15 are respectively provided through the flanges 12 and 13.

A wire holder has a pair of ears 16 and 17 that project from top and bottom edges 18 and 19, respectively, of the main body 11 and from a front face 20.

Aligned holes 21 and 22 are provided through the ears 16 and 17 and a straight pin 24 is adapted to be inserted into the holes 21 and 22. A head 25 on one end of the pin prevents passage of the pin fully through the holes. While a specially constructed single or double headed pin 24 can be used it is preferred that a nail be used. An **8*d*** nail has been found to be very suitable for the purpose.

The main body 11 and flanges 12 and 13 are preferably curved from the center of the main body outwardly and rearwardly so that the clip will generally conform to a wooden post of essentially round cross section.

Figure 3:
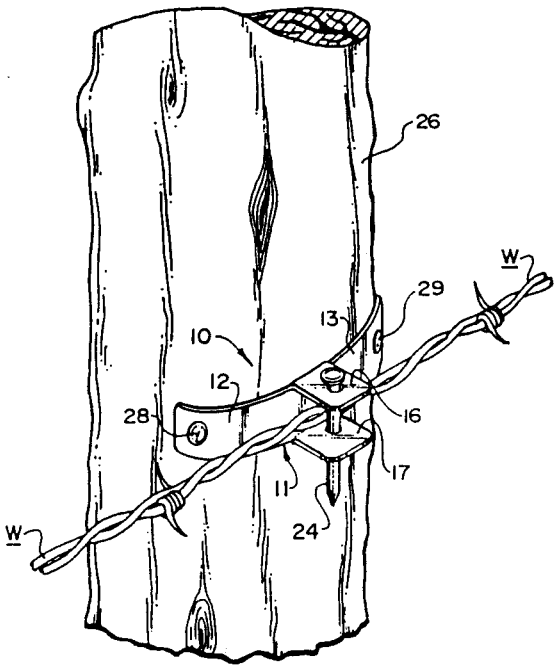

In use, the clip is attached to a post 26, FIG. 3, by positioning the curved back surface 27 against and transverse to the elongate axis of the post, with the ears 16 and 17 projecting away from the post. Nails 28 and 29 are driven into the post through holes 14 and 15 to anchor the clip to the post. A strand of barbed wire W is positioned between the ears and against the main body 11 and the pin 24 and it will be apparent that barb-less wire could be used in place of the barbed wire.

Figure 2:
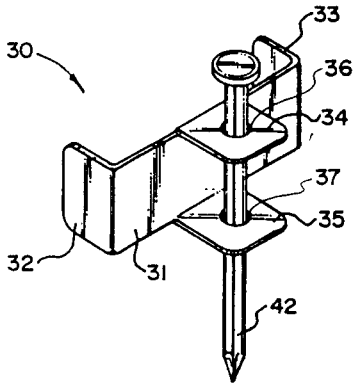
Figure 4:
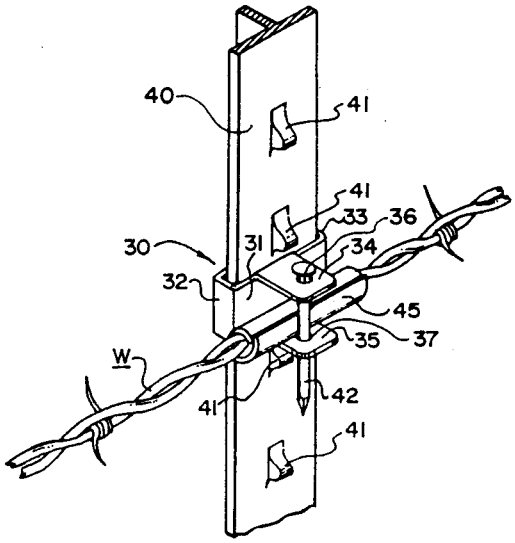

In the embodiment of the invention illustrated in FIGS. 2 and 4, the clip, shown generally at 30, includes a flat main body 31 with flanges 32 and 33 projecting at substantially right angles from opposite ends thereof. The clip 30 has a wire holder including spaced apart ears 34 and 35 and is similar in all respects to the clip 10, previously described, except that the main body is straight, the flanges extend at right angles and no holes are provided through the flanges.

In use, the clip 30 is attached to a conventional metal fence post 40 by bending the flanges rearwardly around the arms of a post having a T-shaped cross-sectional configuration. The clip is positioned between adjacent projections 41 spaced along the face of the post. A strand of wire W is positioned, as previously described, between the ears 34 and 35 and a double-headed pin 42 is inserted down through holes 36 and 37 in the ears 34 and 35. With the double head, the pin 42, which may be and preferably is a standard double-headed nail, is more easily grasped to be pulled from the ears when it is desired to release the wire from the clip. Again it will be apparent that barb-less wire could be secured in place of the barbed wire W.

As shown in FIG. 4, an electrical insulator 45 may be provided to surround the length of barbed wire W extending across the clip 30.

Figure 5:
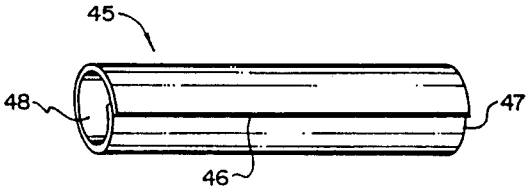

The insulator 45, shown best in FIG. 5, comprises a length of plastic tubing, cut diagonally across its ends and longitudinally at 46 along the sidewall thereof from one pointed end 47 to the opposite end 48 of the wall. The insulator is attached to the stretched wire either before or after the wire is electrified, by hooking the pointed end having the longitudinal cut on the wire and pivoting the insulator over the wire through the cut before the wire is positioned in the clip. The natural resiliency of the plastic tubing then closes the insulator over the wire.

Figure 6:
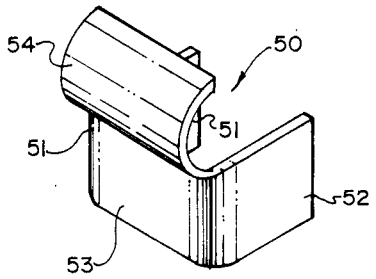
Figure 8:
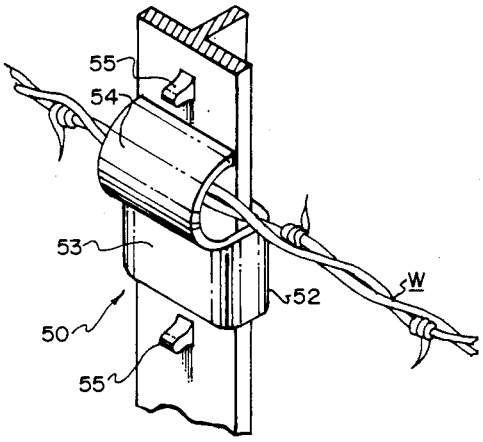

In FIGS. 6 and 8 another embodiment of the clip, shown generally at 50, includes a pair of spaced apart ears 51 and 52 interconnected by a flat segment 53 and a half-tube segment 54 extending from an edge of the flat segment. The clip 50 is attached to a metal post 55 in the manner previously described with reference to FIG. 4. With clip 50, however, the wire W is positioned through the half-tube segment before the ears are bent around the pole.

Figure 7:
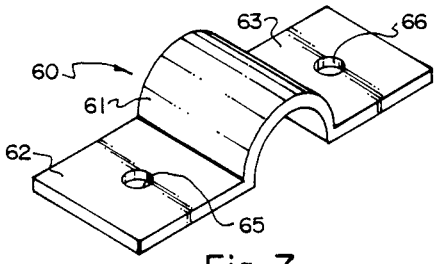
Figure 9:
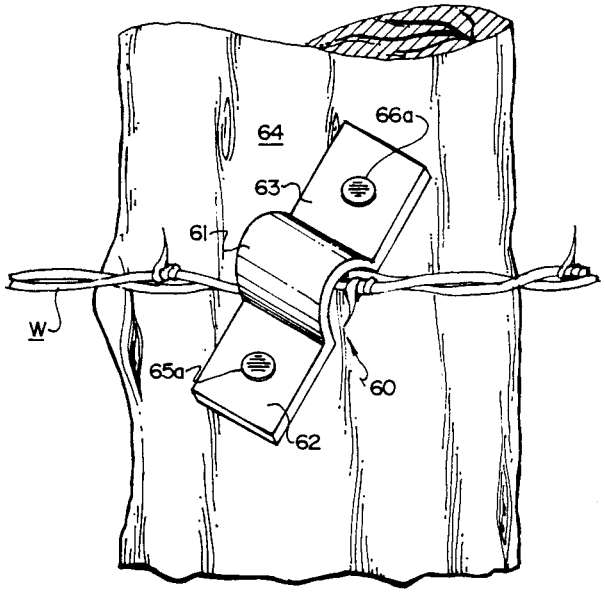

FIGS. 7 and 9 show still another embodiment of the invention. In this embodiment the clip 60 includes a central half-tube section 61 with ears 62 and 63 extending at opposite angles therefrom.

With the ears 62 and 63 extending at opposite angles the clip 60 can be attached to a wooden post 64 by nails 65*a* and 66*a* driven through holes 65 and 66 in the ears 62 and 63 respectively. Because of the angular relationship, when the wire W extends through the half-tube segment parallel to the ground the holes 65 and 66 are offset with respect to vertical. Thus the nails inserted through the holes and into post 64 are not likely to be in the same grain of the post.

Figure 10:
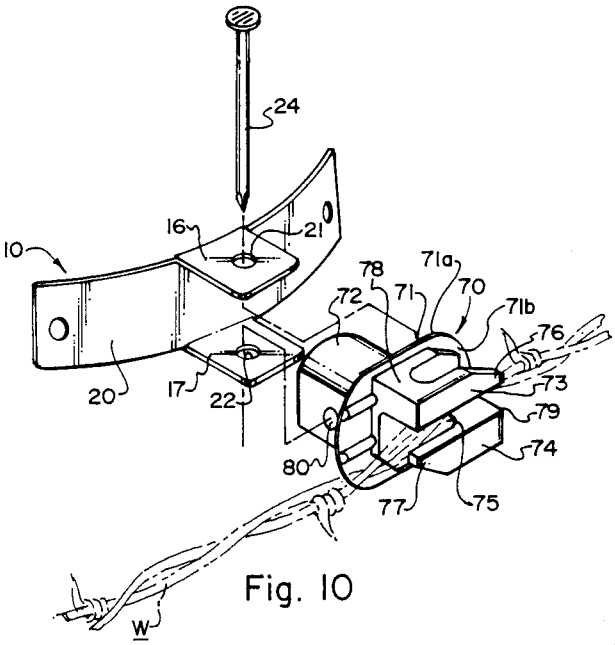
Figure 11:
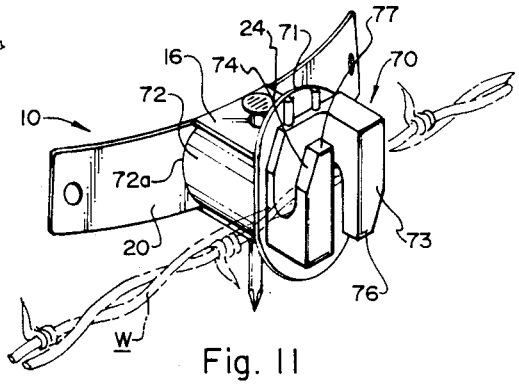

In FIGS. 10 and 11 there is shown another preferred embodiment of insulator connector 70 that is particularly suited for use with the clips shown in FIGS. 1–4.

Connector 70 includes a flange 71 with a boss 72 projecting from one face 71*a* thereof and with oppositely extending fingers 73 and 74 spaced outwardly on opposite face 71*b*. A groove 75 extends between the fingers and the fingers have tip ends 76 and 77, respectively spaced from the flange by bridge members 78 and 79. Each bridge member is grooved so that a taut wire W will extend straight across the bridge members, between the flange and the fingers.

Boss 72 has a hole 80 extending therethrough parallel to the groove 75. The insulator connector 70 is preferably made of a non-conductive plastic or a suitable rubberized material.

In use a taut wire positioned in groove 75 and the connector 70 is rotated a quarter turn (clockwise as viewed in FIGS. 10 and 11) so that finger 73 extends upwardly and finger 74 extends downwardly. The hole 80 then extends transversely to the electrified wire W. The boss 72 is positioned between the ears 16 and 17 of the clip 10 that is subsequently (or previously) nailed to a post such that the end 72*a* of the boss engages or is closely adjacent to the front face 20 of the clip. The pin 24 is inserted through holes 21 and 22 in the clip and through hole 80, whereby the connector is held by the clip and is secured against significant pivoting around pin 24.

It will be apparent that the same connector 70 can be similarly used with the clip 30 of FIGS. 2 and 4.

Although a preferred form of my invention has been herein disclosed, it is to be understood that the present disclosure is by way of example and that variations are possible without departing from the subject matter coming within the scope of the following claims, which subject matter I claim as my invention.

I claim:

1. A fence clip assembly made of strong, durable material and having a main body with a front side, a back side, top and bottom edges and a pair of side edges with said front side extending between each of said side edges; a pair of spaced apart flat ears extending from said front side at said top and bottom edges, respectively, and including aligned holes through said flat ears; an insulator connector, providing insulation for wire, extending between said flat ears and across said front side of said main body, said insulator connector comprising a flange with front and back faces and including a boss with a hole therethrough projecting from said back face and oppositely extending fingers spaced outwardly from said front face of said flange, said fingers having tip ends respectively spaced from said flange by bridge members, said bridge members being grooved permitting a wire to extend straight across said bridge members, between said insulator flange and said fingers; and a pin having a head on one end thereof and extending through the aligned holes in said main body flat ears and the hole in the boss of said insulator connector whereby the connector is held by said clip and is secured against significant pivoting around said pin.

* * * * *